US005692316A

United States Patent [19]

Antal

[11] Patent Number: 5,692,316

[45] Date of Patent: Dec. 2, 1997

[54] APPAREL DRYING RACK APPARATUS FOR BOOTS AND GLOVES

[76] Inventor: Christopher P. Antal, P.O. Box 37, South Pomfret, Vt. 05067

[21] Appl. No.: 611,515

[22] Filed: Mar. 7, 1996

[51] Int. Cl.[6] ..... F26B 25/00

[52] U.S. Cl. ..... 34/106; D32/58

[58] Field of Search ..... 34/104, 106, 107, 34/184, 187, 239, 240; 211/34, 35, 37; D32/58

[56] References Cited

U.S. PATENT DOCUMENTS

| | | | |
|---|---|---|---|
| 647,784 | 4/1900 | Allen | 211/34 |
| 940,812 | 11/1909 | Herman | 211/34 |
| 1,606,451 | 11/1926 | Sanders | 211/35 |
| 3,608,738 | 9/1971 | Anderson . | |
| 3,798,788 | 3/1974 | Kuntz | 34/104 |
| 4,787,153 | 11/1988 | Chen . | |
| 5,323,544 | 6/1994 | Osgood | 34/104 X |

*Primary Examiner*—John M. Sollecito
*Assistant Examiner*—Steve Gravini
*Attorney, Agent, or Firm*—Thomas N. Neiman

[57] ABSTRACT

The apparel drying rack apparatus for boots and gloves comprises a plurality of shaped wire holding units that are positioned rigid base frame. The holding units are designed to rotate within the base frame to allow the apparatus to be stored in a flattened position. The apparatus is designed to fit easily over air ducts or baseboard heaters and a wall mounted apparatus is also disclosed. The baseboard fitting apparatus has an adjustment system that allows the apparatus to fit over baseboards having various heights.

4 Claims, 5 Drawing Sheets

APPAREL DRYING RACK APPARATUS FOR BOOTS AND GLOVES

BACKGROUND OF THE INVENTION

This invention pertains to drying devices, and, in particular, to an apparel drying rack apparatus for boots and gloves to be used with household hot air and hot water heating systems to facilitate drying of apparel.

There are a number of devices designed to facilitate drying of winter apparel available on the market today. Some are designed as rack for shoes and boots and some are designed specifically for drying purposes. Examples of those devices which have received United States patents are the patent issued to Yi Chen, U.S. Pat. No. 4,787,153 on 29 Nov. 1988 for a "Shoe Drier" and the patent issued to Sally-Rae Anderson, U.S. Pat. No. 3,608,738 on 28 Sep. 1971 for a "Boot Drying Rack". The shoe drier is an electric device that holds the shoes being dried an blows hot air into them. The rack is designed to fit over hot air registers and hold the shoe inverted to facilitate the drying of the shoes.

Clearly, it is desirable for a device of this type to be very lightweight and rigid. At the same time, the device should be easy to install and be extremely simple to position over both registers and hot water baseboard heaters and be able to hold a plurality of apparel items such as gloves, mittens, hats and boots or shoes. An object of this invention is to provide a device that is simple to manufacture and simple to install for use. It is another object of this invention to teach a device that will allow the user to fold the unit into a storage position easily and allow the user to take the apparel drying rack apparatus with him or her on their travels. It is also the object of this invention to teach an improved drying rack device for boots and gloves which avoids the disadvantages, limitations, above-recited, obtained from previous drying devices.

SUMMARY OF THE INVENTION

It is also the object of this invention to teach an apparel drying rack apparatus which is simple to install and use. Particularly, it is the object of this invention to set forth an apparel drying rack apparatus for boots and gloves, for use with household hot air and hot water heating systems to facilitate drying of gloves, hats, mittens boots and the like, comprising at least two base pieces; said base pieces comprising rigid support frames for providing stability for said apparel drying rack apparatus; said base piece having vertical receiving apertures positioned therein; a plurality of apparel extension prongs for holding individual items of apparel; said apparel extension prongs comprising shaped wire rods inserted within said vertical receiving apertures in each of said base pieces; and attachment means for locking said apparel extension prongs in said base pieces and, at the same time, permitting said apparel extension prongs to rotate within said base piece. It is also the object of this invention to teach an apparel drying rack apparatus for boots and gloves for use with household hot air and hot water heating system to facilitate drying of gloves, hats, mittens, boots and the like, comprising at least two base pieces; said base pieces comprising rigid support frames for providing stability for said apparel drying rack apparatus; said base pieces having vertical receiving apertures positioned therein; a plurality of apparel extension prongs for holding individual items of apparel; said apparel extension prongs comprising shaped wire rods inserted within said vertical receiving apertures in each of said base pieces; attachment pieces for locking said apparel extension prongs in said base pieces and, at the same time, permitting said apparel extension prongs to rotate within said base piece; and a foot extension system attached to one of said base pieces for allowing said apparel drying rack apparatus to easily stand upright next to a baseboard heating unit. Finally, it is the object of this invention to teach an apparel drying rack apparatus for boots and gloves, for use with household hot air and hot water heating systems to facilitate drying of gloves, hats, mittens, boots, and the like, comprising a single wall mounted base; said single wall mounted base comprising a rigid support frame fox providing stability for said apparel drying rack apparatus; said single wall mounted base having a plurality of horizontal apertures positioned in a pattern of twos, on directly above the other; a plurality of apparel extension prongs inserted into said single wall mounted base; said apparel extension prongs comprise a F—shaped design laying on their sides facing upward; and wall mounting means comprising mounting screws inserted through said single wall mounted piece into the wall.

BRIEF DESCRIPTION OF THE DRAWINGS

Further objects and features of this invention will become more apparent by reference to the following description taken in conjunction with the accompanying figure, in which.

DETAILED DESCRIPTION OF THE PREFERRED EMBODIMENT

Figure 1:
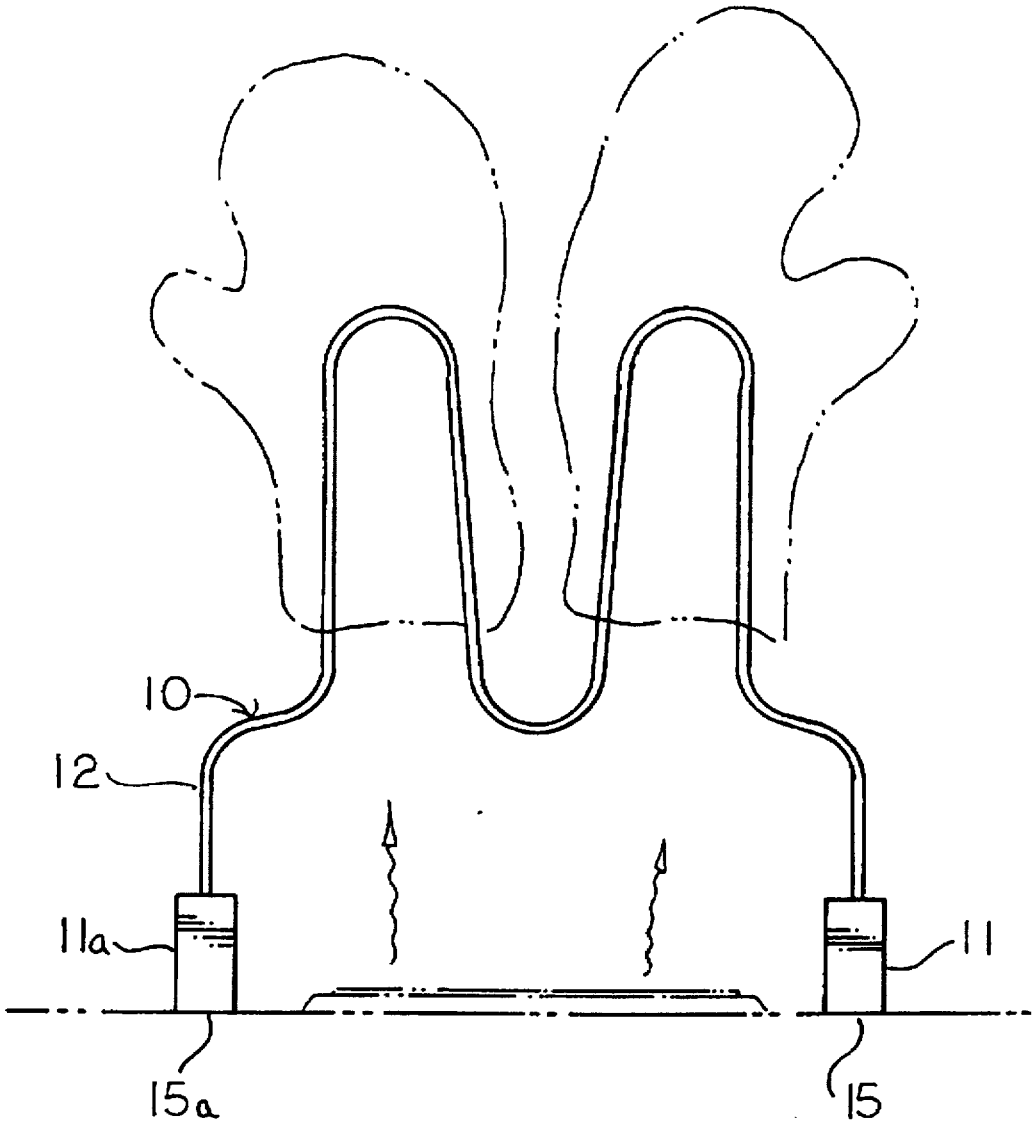
FIG. 1 is a side elevational view of the novel apparel drying rack apparatus.
Figure 4:
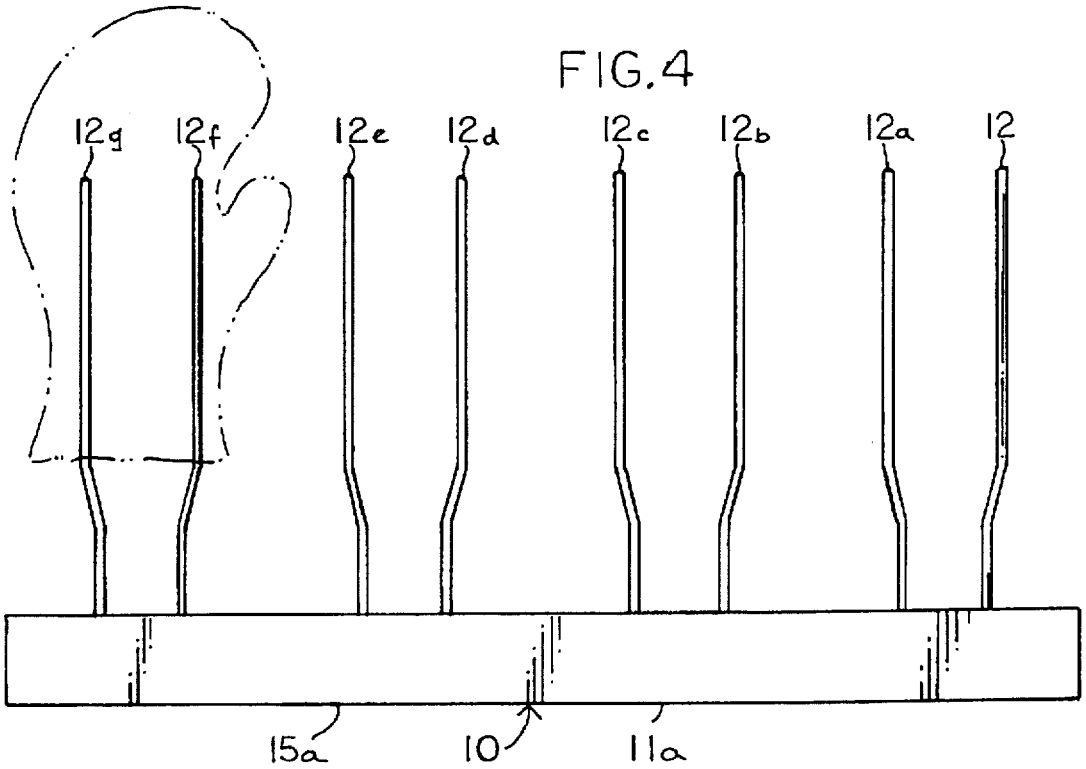
FIG. 4 is a front elevation view of FIG. 1.
Figure 5:
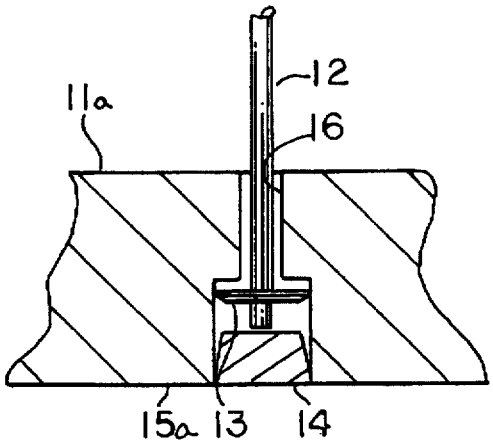
FIG. 5 is an enlarged cross-sectional view of a prong connection.

As shown in the FIGS. 1, 4 and 5 the novel apparel drying rack apparatus 10 is designed to stand over hot air heating registers. The unit has a pair of rigid, hardwood base pieces 11 and 11*a* which have a flattened bottom portion 15 and 15*a* for the purpose of being able to easily stand solidly on the floor. The apparel extension prongs 12, 12*a*, 12*b*, 12*c*, 12*e*, 12*f* and 12*g* are M—shaped wire rods that are inserted into vertical apertures 16 (only one shown) drilled into the base pieces 11 and 11*a*. A push nut 13 is inserted over the end of the apparel extension prongs 12 which locks the prong in position and also allows the prong to rotate permitting the apparatus to fold flat for traveling or storing purposes. A wooden dowel 14 is used to seal the base of the aperture and give a smooth appearance to the bottom portion of the apparatus. The prongs are positioned in parallel aperture in each base and have two of the prongs close together with a larger space before getting to the next pair of prongs. This is done to optimize the function of the apparatus by allowing the user to place gloves over two adjacent prongs to improve air circulation.

Figure 2:
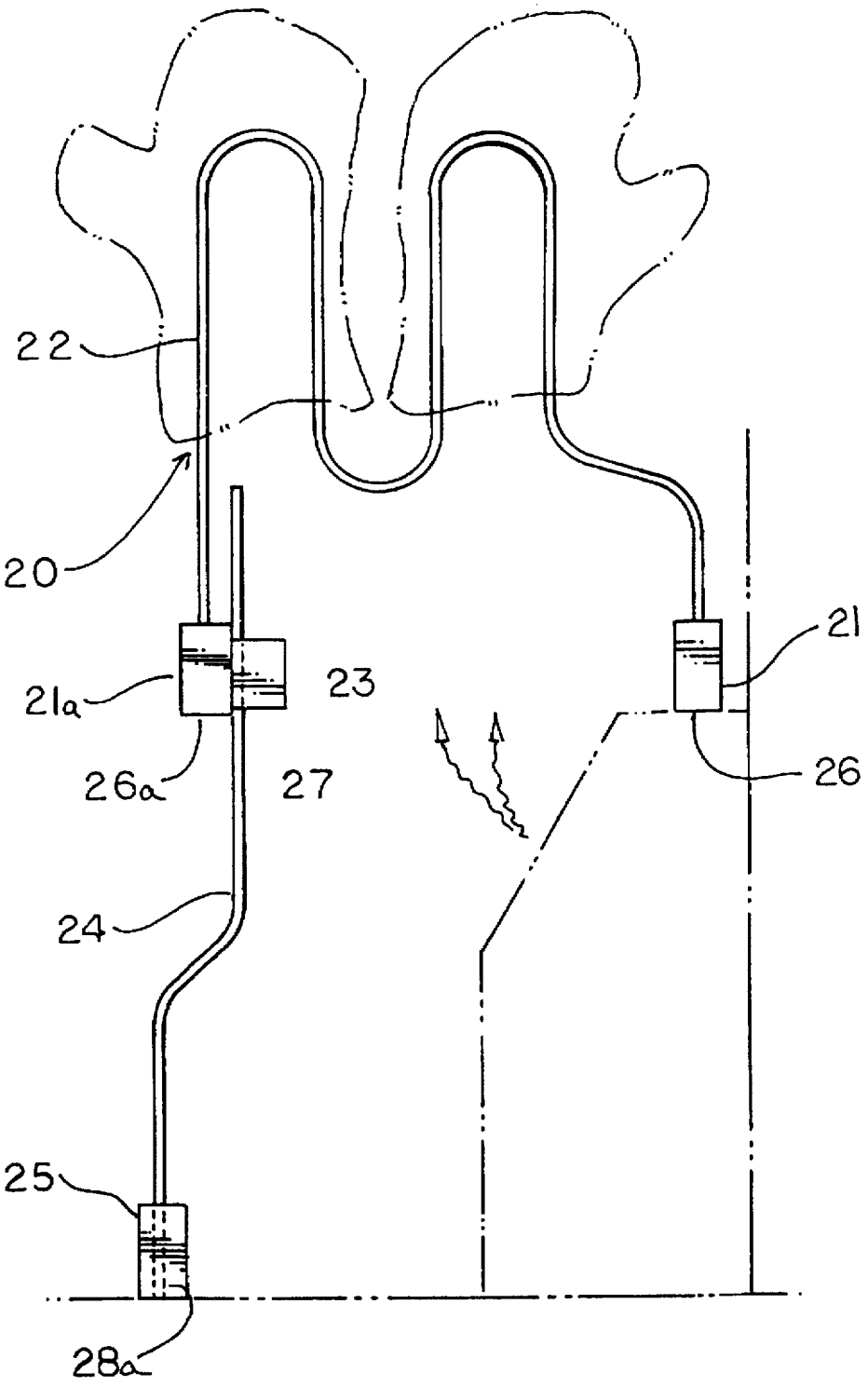
FIG. 2 is a side elevational view of the baseboard unit.
Figure 6:
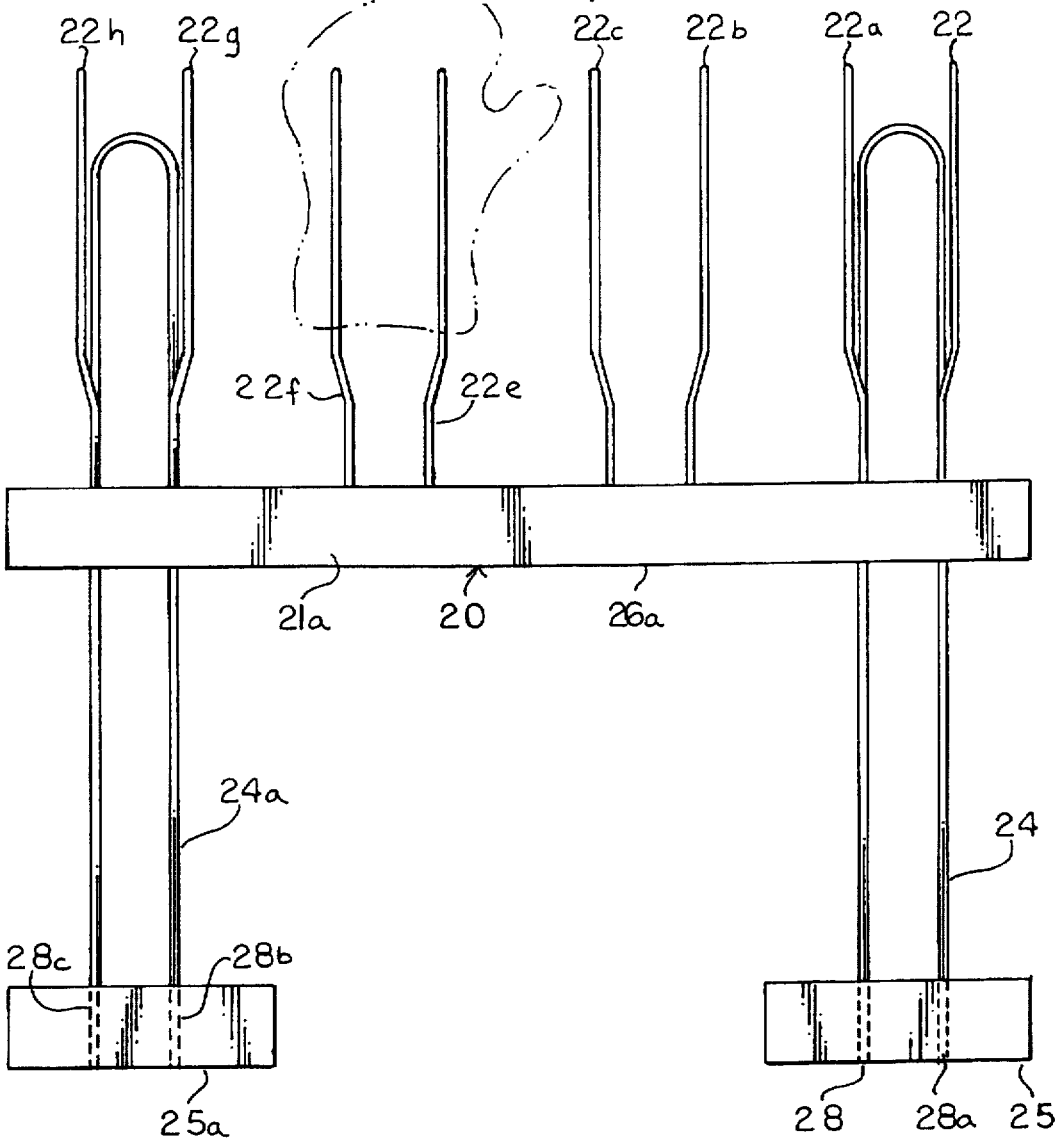
FIG. 6 is a front elevational view of FIG. 2.

The apparatus 20 shown in FIGS. 2 and 6 is designed to fit comfortably over household hot water baseboard heating units. It contains two base pieces 21 and 21*a* and a plurality of M—shaped extension prongs 22 through 22*g* that are arranges and held in position in the same fashion as the heat register version. The base pieces 21 and 21*a* have a flattened bottom portion 26 and 26*a*. The differences in the apparatus is that the baseboard unit has an adjustable foot extension system that consists of a pair of adjustment pads 23 (is shown). The pads 23 are attached to one of the base pieces 21*a* at each of the longitudinal ends of the base piece. A pair of slots (27*a* is shown) are cut into the pads at a position adjacent to the base piece and a pair of looped wire rods 24 and 24*a* are inserted into the slots with the two ends of each wire rod facing downward and are inserted into apertures 28 through 28*a* in resting blocks 25 and 25*a* that allows the apparatus to rest one side on the floor of the dwelling while the other side of the apparatus rests on the baseboard unit. The height adjustment is controlled screws that attach the pads 23 and 23*a* to the base piece 21*a*. Those screws can be loosened or tightened to adjust the position of the looped wire rods 24 and 24*a*.

Figure 3:
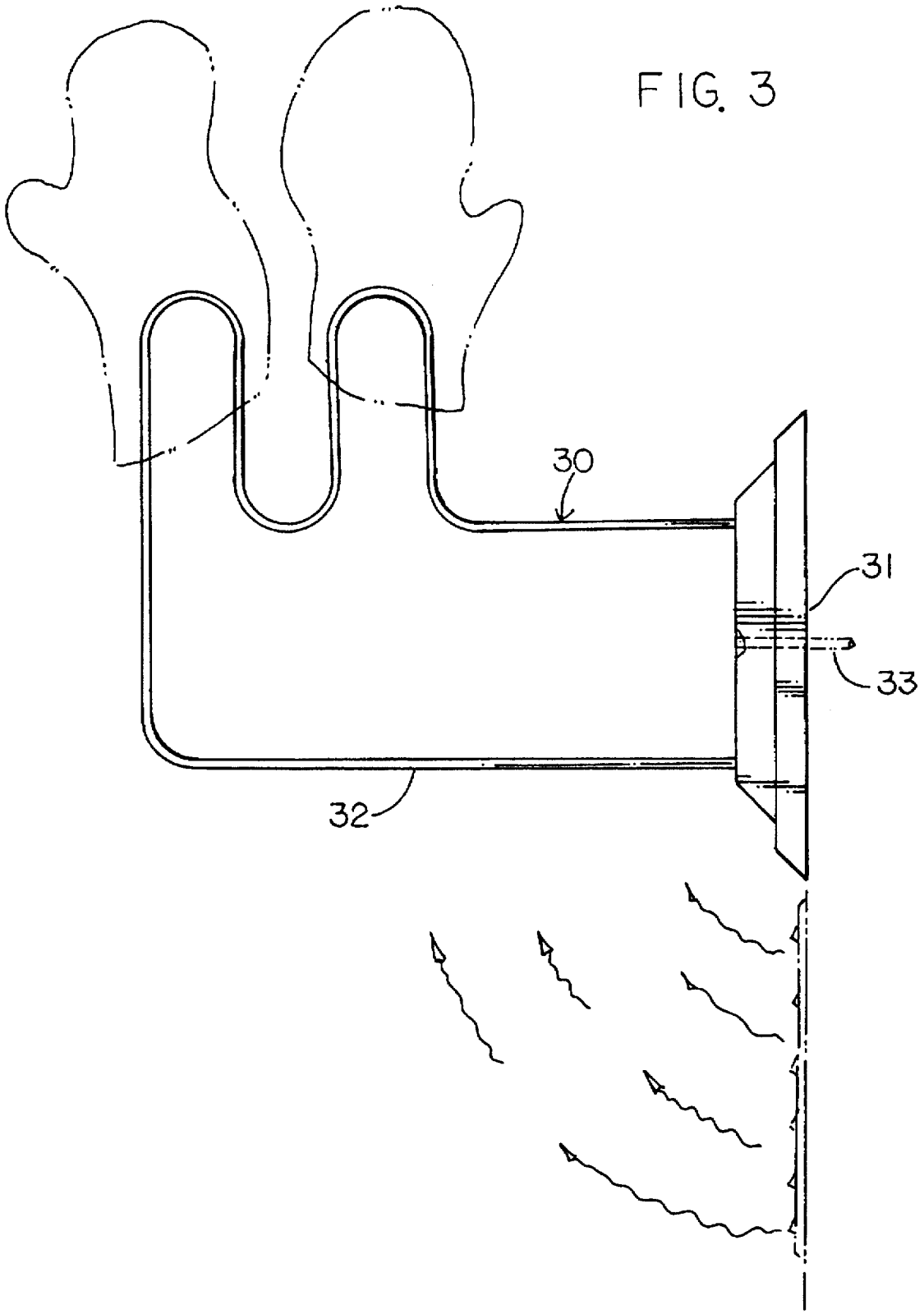
FIG. 3 is a side elevational view of the wall mounted unit.

The version shown if FIG. 3 is a wall mounted apparatus 30 that has a wall plate or base piece 31 that is screwed into the wall above a wall mounted register by means mounting screws 33 (shown). The shape of the apparel extension unit 32 is F—shaped sideways facing upward. There is only one base piece 31 in these units. The preferred embodiment of these units is constructed of hard-wood and plated steel wire. However, it would be viable to construct the entire apparatus of metal or plastic materials.

While I have described my invention in connection with specific embodiments thereof, it is clearly to be understood that this is done only by way of example and not as a limitation to the scope of my invention as set forth in the objects thereof and in the appended claims.

I claim:

1. An apparel drying rack apparatus for boots and gloves, for use with household hot air and hot water heating systems to facilitate drying of gloves hats, mittens, boots and the like, comprising:

at least two base pieces;

said base pieces comprising rigid support frames for providing stability for said apparel drying rack apparatus;

said base pieces having vertical receiving apertures positioned therein;

a plurality of apparel extension prongs for holding individual items of apparel;

said apparel extension prongs comprising shaped wire rods inserted within said vertical receiving apertures in each of said base pieces; and attachment means for locking said apparel extension prongs in said base pieces and, at the same time, permitting said apparel extension prongs to rotate within said base piece.

2. An apparel drying rack apparatus for boots and gloves, according to claim 1, wherein:

said attachment means comprises a push nut inserted onto the base of said end apparel extension prongs for locking said apparel extension prongs in said base piece and, at the same time, allow rotation of said apparel extension prong; and said attachment means further comprises said base of said apparel extension prongs being pressed flat into a mushroom shape.

3. An apparel drying rack apparatus for boots and gloves, for use with household hot air and hot water heating systems to facilitate drying of gloves, hats mittens, boots and the like, comprising:

at least two base pieces;

said base pieces comprising rigid support frames for providing stability for said apparel drying rack apparatus;

said base pieces having vertical receiving apertures positioned therein;

a plurality of apparel extension prongs for holding individual items of apparel;

said apparel extension prongs comprising shaped wire rods inserted within said vertical receiving apertures in each of said base pieces;

attachment means for locking said apparel extension prongs in said base pieces and, at the same time, permitting said apparel extension prongs to rotate within said base piece; and a foot extension system attached to one of said base pieces for allowing said apparel drying rack apparatus to easily stand upright next to a baseboard heating unit.

4. An apparel drying rack apparatus for boots and gloves, according to claim 3, wherein:

said attachment means comprises a push nut inserted onto the base of said end apparel extension prongs for locking said apparel extension prongs in said base piece and, at the same time, allow rotation of said apparel extension prong; and said attachment means further comprises said base of said apparel extension prongs being pressed flat into a mushroom shape.

* * * * *